US008568090B2

(12) United States Patent
Guo et al.

(10) Patent No.: US 8,568,090 B2
(45) Date of Patent: Oct. 29, 2013

(54) SYSTEM FOR REDUCING THE LEVEL OF EROSION AFFECTING A COMPONENT

(75) Inventors: Tao Guo, Niskayuna, NY (US); Jonathon E. Slepski, Clifton Park, NY (US); Kenneth M. Koza, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 666 days.

(21) Appl. No.: 12/632,152

(22) Filed: Dec. 7, 2009

(65) Prior Publication Data

US 2011/0135447 A1 Jun. 9, 2011

(51) Int. Cl.
*F01D 9/00* (2006.01)

(52) U.S. Cl.
USPC ..... 415/169.1; 415/169.2; 415/169.3; 415/115; 416/231 R; 416/90 R; 416/91

(58) Field of Classification Search
USPC ..... 415/169.1, 169.2, 169.3, 115; 416/231 R, 90 R, 91
See application file for complete search history.

(56) References Cited

U.S. PATENT DOCUMENTS

| | | | | |
|---|---|---|---|---|
| 4,578,018 | A | 3/1986 | Pope | |
| 7,318,699 | B2 * | 1/2008 | Serafini et al. | 415/169.4 |
| 7,422,415 | B2 | 9/2008 | Burdgick et al. | |
| 2007/0014670 | A1 * | 1/2007 | Maeno | 416/232 |
| 2008/0050221 | A1 | 2/2008 | Burdgick et al. | |
| 2010/0329853 | A1 * | 12/2010 | Guo et al. | 415/169.2 |
| 2011/0135447 | A1 * | 6/2011 | Guo et al. | 415/115 |

FOREIGN PATENT DOCUMENTS

| | | | | |
|---|---|---|---|---|
| EP | 1744018 | A1 | | 1/2007 |
| JP | 63183205 | A | * | 7/1988 |
| JP | 63263204 | A | * | 10/1988 |
| JP | 63280801 | A | | 11/1988 |
| JP | 01045904 | A | * | 2/1989 |
| JP | 01163404 | A | * | 6/1989 |
| JP | 2004124751 | A1 | | 4/2004 |

OTHER PUBLICATIONS

GB Search Report issued in connection with corresponding GB Application No. GB1020082.2, Mar. 17, 2011.

* cited by examiner

*Primary Examiner* — Edward Look
*Assistant Examiner* — Christopher R Legendre
(74) *Attorney, Agent, or Firm* — Ernest G. Cusick; Frank A. Landgraff

(57) ABSTRACT

A system for removing moisture from a steam/water mixture engaging a stationary component of a steam turbine. The system includes an airfoil located within a flow path of a steam turbine. The airfoil is configured for removing moisture from a steam/water mixture traveling in the flow path. To this end, the airfoil includes a cavity in flow communication with the steam path through at least one inlet and outlet opening, near the leading and trailing edge of the airfoil, respectively. Moisture and steam are extracted from the surface through the inlet openings, the steam and water are separated in the cavity, the separated water flows towards the bottom end, and the dry steam flows through the outlet opening and returns to the steam path. The dry steam blowing out of the trailing edge reduces the size of secondary droplets, and thereby prevents erosion.

20 Claims, 5 Drawing Sheets

SYSTEM FOR REDUCING THE LEVEL OF EROSION AFFECTING A COMPONENT

BACKGROUND OF THE INVENTION

The present application relates generally to steam turbines, and more particularly, to systems for reducing the level of erosion experienced by steam turbine components.

Low-pressure steam turbines are typically driven by wet steam, the moisture content of which may have the form of water film or water droplets. This moisture causes efficiency losses and potential erosion of steam turbine components. This erosion is most prominent in steam turbine airfoils/blades as the moisture content of the steam impacts the nozzles (stationary airfoils) or buckets (rotating airfoils). The erosion is even more exaggerated in some last stages of steam turbines, where speed and local wetness values are highest.

Several solutions have been proposed to reduce the amount and/or size of water droplets accumulated on steam turbine components. One solution adds radial grooves close to the leading edge of rotating airfoils to remove the deposited moisture. These grooves, however, only remove moisture that has already caused significant efficiency losses to the rotating airfoils and upstream stationary airfoils. Other solutions rely on protective measures, which include water removal through water drainage arrangements in outer sidewalls (end walls) of the nozzle; or through suction slots made in hollow stator airfoils. This moisture is then collected in circumferential cavities between the diaphragm and the casing and drained to a condenser.

These moisture removal concepts are based on extraction of moisture film from blade surfaces, through slots, driven by the pressure drop between the steam path and the hollow blade inner space. This pressure drop causes a significant amount of steam to pass through the hollow stator blades and into the condenser. This decreases the steam turbine efficiency.

Another recently developed technique extracts moisture from blade surfaces through multiple extraction bores in the airfoils. There, the extracted moisture is led to an external steam/moisture separator, the separated water is drained, and the steam is returned back to the main steam path through a steam injection bore located in the center of the pressure side. This technique provides moisture removal as well as steam reinsertion into the steam path, thus improving steam turbine efficiency. There remains, however, room for improvement in providing further structures aimed at reducing blade erosion.

As a result, there is a desire for improved systems for efficiently and cost effectively reducing moisture-related issues in steam turbine components, such as efficiency losses and potential erosion.

BRIEF DESCRIPTION OF THE INVENTION

The present application describes a system for removing moisture from a steam/water mixture engaging a stationary component of a steam turbine. The system includes an airfoil, which is disposed in a group of airfoils located within a flow path of a steam turbine. The airfoil is configured for removing moisture from a steam/water mixture traveling in the flow path. Here, the airfoil includes a first and second longitudinal ends and an outer peripheral wall that integrates the first and second longitudinal ends. The first and second longitudinal ends and the outer peripheral wall collectively define a leading edge, a trailing edge, a suction-side face, and a pressure-side face of the airfoil. The airfoil further includes an extraction cavity laterally extending between a portion of the leading edge and a portion of the trailing edge; the extraction cavity comprising an inlet opening in flow communication with the flow path, and an outlet opening in flow communication with the flow path. Moreover, the airfoil includes a cavity configured for separating the steam/water mixture into steam and water, which extends longitudinally within at least a portion of the airfoil. The cavity comprises a top end integrated with the extraction cavity, and a bottom end configured for allowing water to exit the airfoil. As the steam/water mixture travels in the flow path, the inlet opening draws in a portion of the steam/water mixture. A pressure drop across the leading edge and the trailing edge then allows for the portion of the steam/water mixture to enter the cavity. Density differences of the steam and water allow the water to separate from the steam. The separated water flows towards the bottom end, and the steam flows through the outlet opening and returns to the steam path.

These and other features of the present application will become apparent upon review of the following detailed description of the preferred embodiments when taken in conjunction with the drawings and the appended claims.

BRIEF DESCRIPTION OF THE DRAWINGS

FIG. 1 is a schematic cross-sectional view of a portion of a steam turbine stage illustrating steam and moisture flow there through.

DETAILED DESCRIPTION OF THE INVENTION

The following terms used in the description are defined as follows. The terms "downstream" and "upstream" indicate a direction relative to the flow of working fluid through the steam turbine. As such, the term "downstream" means the direction of the flow, and the term "upstream" means in the opposite direction of the flow through the steam turbine. Related to these terms, the terms "aft" and/or "trailing edge" refer to the downstream direction, the downstream end and/or in the direction of the downstream end of the component being described. Moreover, the terms "forward" or "leading edge" refer to the upstream direction, the upstream end and/or in the direction of the upstream end of the component being described.

Figure 1:
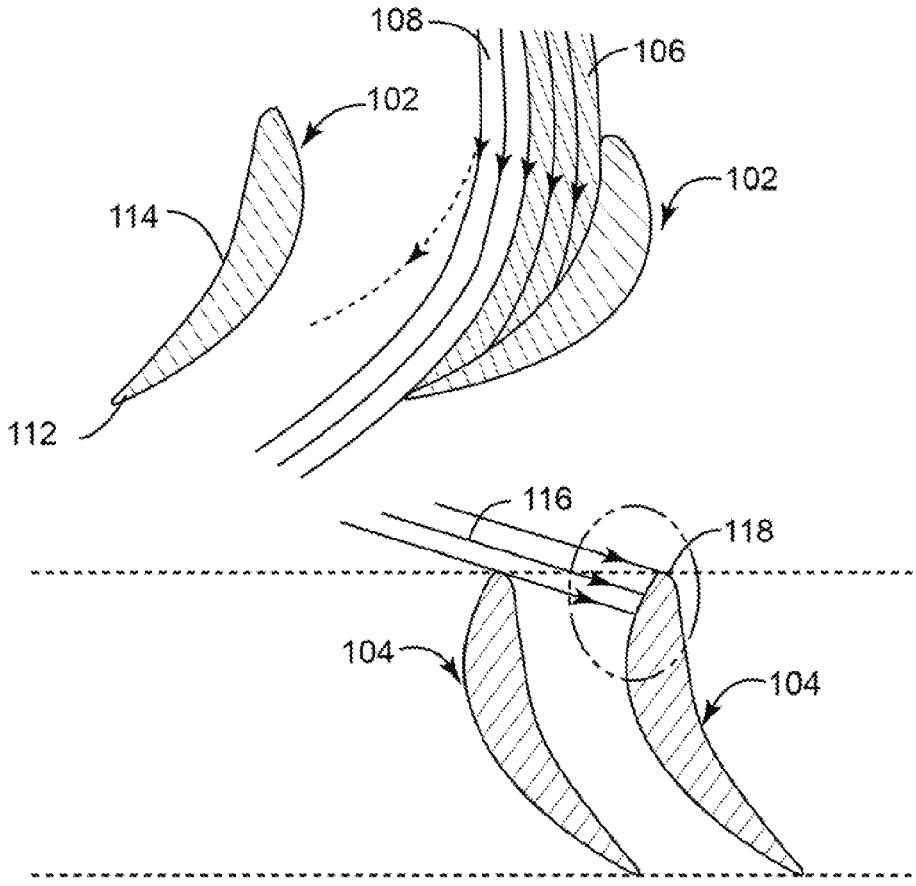

FIG. 1 is a schematic cross-sectional view of a portion of a steam turbine stage illustrating steam and moisture flow there through. FIG. 1 illustrates a portion of a steam turbine stage illustrating the steam and moisture flow through the various stage components. A steam turbine stage generally include two rows of interspersed airfoils—one row of stationary airfoils 102 and the other of rotating airfoils 104, with the rotating airfoils 104 disposed downstream of the stationary airfoils 102. The stationary airfoils 102 (sometimes referred to as nozzles) can direct the steam onto the rotating airfoils 104 (sometimes referred to as buckets) to cause the rotating airfoils 104 to rotate with a speed corresponding to the steam pressure. Together, a set of stationary airfoils 102 and a set of rotating airfoils 104 form a steam turbine stage, and the steam turbine may include multiple such stages.

In low-pressure steam turbines, some of the steam may nucleate to form moisture droplets, referred to as primary droplets 106, which can be very small (typically less than 0.2 micron). As illustrated in FIG. 1, these primary droplets 106 generally follow the main steam path (depicted generally at 108); However, due to inertial and turbulent deposition, some primary droplets 106 can deposit on the nozzle surfaces in the form of water films or rivulets and may travel downstream to the trailing edge 112 of the nozzle. Additionally, since the main steam path 108 is turning inside the airfoil channel, the centrifugal force will push the droplets towards the pressure side face 114 of the airfoil. These droplets will also accumulate near the trailing edge 112 of the pressure side face of the airfoil; forming water films and rivulets that travel downstream to the trailing edge 112. On reaching the trailing edge 112, these water films or rivulets tend to liberate from the stationary airfoil 102 and may form relatively larger secondary droplets 116 (as large as 100-300 microns).

Secondary droplets 116 may be accelerated by the main steam path 108, and due to size, may lag behind the main steam path 108. The secondary droplets 116, moving slower than the surrounding steam, may reach the downstream rotating airfoils 104 and impact the suction side (convex side) of the leading edge 118. This moisture impact may cause potential erosion and efficiency losses in the steam turbine.

Figure 2:
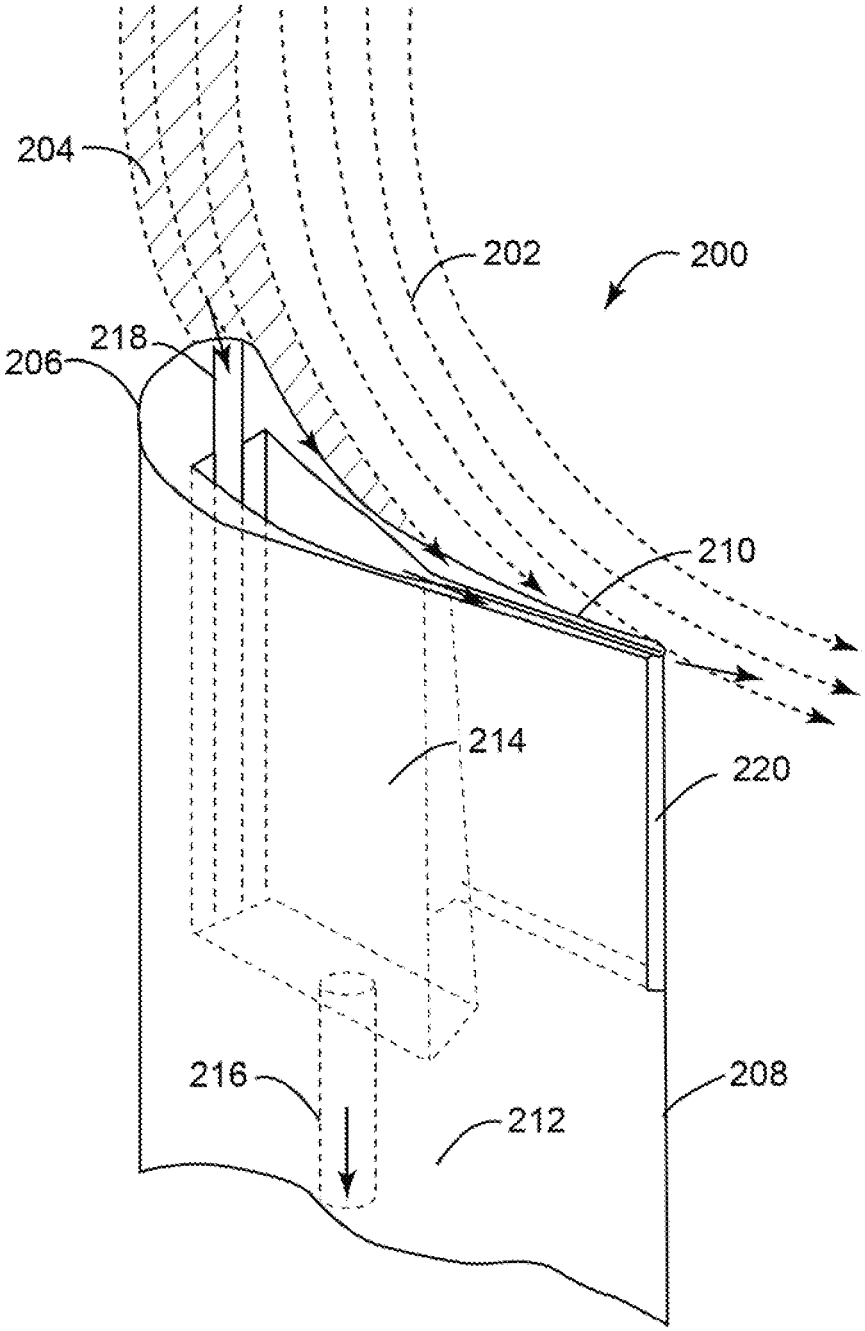
FIG. 2 is a schematic illustrating an isometric view of an airfoil, in accordance with an embodiment of the present invention.
Figure 3:
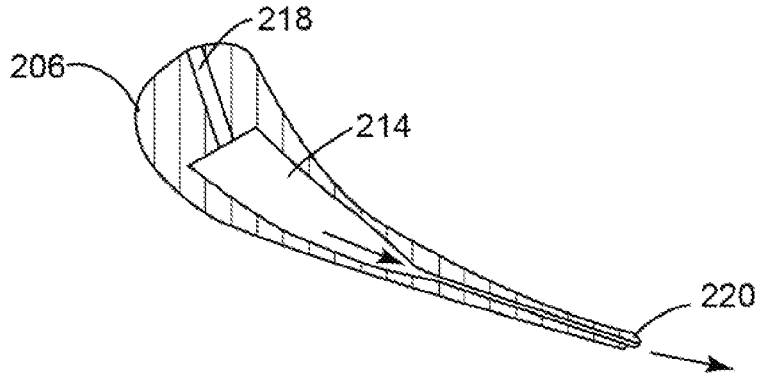
FIG. 3 is a top sectional view of the airfoil of FIG. 2, illustrating the flow path through the airfoil, in accordance with an embodiment of the present invention.

To reduce the erosion effects on the rotating blades and to improve steam turbine efficiency, an embodiment of the present invention provides an improved airfoil 200. FIG. 2 is a schematic illustrating an isometric view of an airfoil 200, in accordance with an embodiment of the present invention. In one embodiment, the airfoil 200 may be a stationary airfoil, which may be interspersed in a set of airfoils, or the airfoil 200 may be a first stage stationary airfoil. The airfoil 200 may be located within a low-pressure steam turbine, as seen in FIG. 2, in which the main steam path 202 is indicated by dotted lines, and hashed lines indicate the moisture path 204. The airfoil 200 may generally be described as having two longitudinal ends and a peripheral wall, defining a leading edge 206, a trailing edge 208, a pressure-side face 210, and a suction-side face 212.

Figure 5:
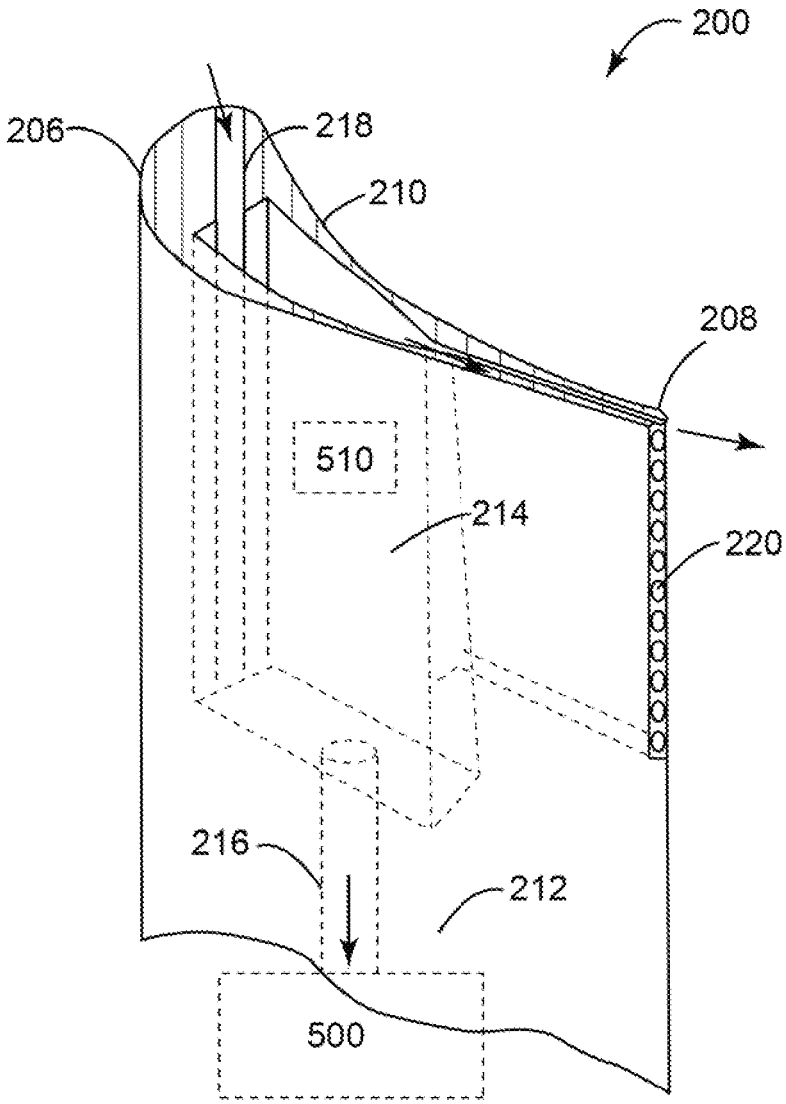
FIG. 5 is a schematic isometric view of an airfoil having multiple openings, in accordance with another alternate embodiment of the present invention.

An embodiment of the airfoil 200 may include at least one opening 218 to draw in moisture from the airfoil 200 surface. Some steam may also escape with the moisture; to return this steam to the main steam path 202, the airfoil 200 may include a cavity 214 that separates the moisture from the steam, drains the moisture, and returns dry steam to the main steam path 202. This feature of the cavity 214 may increase the steam turbine efficiency. The cavity 214 may extend longitudinally through at least a portion of the length of the airfoil 200. The top end of the cavity 214 may be integrated with the top end surface of the airfoil 200, while the bottom end of the cavity 214 may include a moisture draining facility 216. The moisture draining facility 216 may be connected to an external condenser. This may allow the drained water to flow to the condenser for further use. The moisture draining facility 216 from each airfoil 200 may be connected to a circumferential cavity in the diaphragm outer ring, or the inner ring, that provides water collected from the airfoil 200 to the external condenser. In an alternate embodiment, the airfoil 200 may be hollow and not integrated with condenser. In an alternate embodiment of the present invention, the moisture draining facility 216 may discharge to a common receiver 500, as illustrated in FIG. 5.

One or more inlet openings 218 and outlet openings 220 connecting the airfoil surface to the cavity 214 may extract moisture from the surface of the airfoil 200 and re-introduce the dry steam into the main steam path 202, respectively. Moreover, the inlet openings 218 and outlet openings 220 may include multiple openings or a single longitudinally extending cavity, depending on the application. FIG. 2 depicts one embodiment of the inlet openings where the inlet opening 218 may connect the cavity 214 to the outer surface of the leading edge 206. The inlet opening 218 may extend longitudinally along at least a portion of the leading edge 206. The inlet opening may be in flow communication with the main steam path 202. This inlet opening 218 may extend from the outer surface of the leading edge 206 to the cavity 214.

The location of the inlet openings 218 may be based on pressure distribution across the airfoil 200. A single inlet opening 218 may be located at any position on the airfoil 200 that allows moisture extraction, such as the leading edge 206, the pressure-side face 210, or the suction-side face 212. If the airfoil 200 includes multiple inlet openings 218, the location of the inlet openings 218 on the airfoil surface may be selected to minimize the pressure difference between the multiple inlet openings 218. Maintaining a minimum pressure difference between the inlet openings 218 may ensure that steam entering from one inlet opening 218 does not exit from another inlet opening 218. For example, but not limiting of, the inlet openings 218 may be located on the airfoil surface in regions of maximum moisture impact having similar pressure values.

The outlet openings 220, similarly, may be positioned based on the pressure distribution across the airfoil 200. The outlet opening 220 may be at a lower pressure level than that of the inlet openings 218, so that steam moves toward the low-pressure area and exits the airfoil 200. The trailing edge 208 typically has the lowest pressure value on the airfoil 200; and in one embodiment, the outlet opening 220 may be positioned near the trailing edge 208. The outlet opening 220 may extend from the cavity 214 to the surface of the trailing edge 208. The outlet opening 220 may also extend longitudinally along at least a portion of the trailing edge 208. The outlet opening 220 may also be in flow communication with the main steam path 202. In other embodiments, the outlet opening 220 may be positioned at a relatively lower pressure region than the inlet openings 218. In FIG. 2, embodiments of the inlet opening 218 and outlet opening 220 are illustrated as single elongated slots extending along the airfoil edges.

The inlet opening 218, which may be located on the leading edge 206, may draw in the water film/droplets due to a pressure difference between the main steam path 202 and the cavity 214. The structure of the passage between the inlet opening 218 and the outlet opening 220 may induce a negative pressure at the trailing edge 208 of the airfoil 200. That effect, combined with the relatively high pressure at the inlet opening 218, may produce a net pressure drop across the airfoil 200, inducing a general flow towards the trailing edge 208. Consequently, steam (from the main steam path 202) may also be drawn into the cavity 214 through the inlet opening 218. After the steam-water mixture enters the cavity 214, water may naturally separate from the mixture. This effect may occur because of the velocity decrease associated with the effect of relatively larger cavity size 214.

Gravity acts on the low-velocity steam-water mixture; and the denser water, naturally separates from the mixture, and may be collected at the bottom of the cavity 214. The remaining steam may flow towards the trailing edge 208 (as the pressure at the trailing edge 208 may be the lower). This steam may be re-introduced to the main steam path 202 via the outlet opening 220. Here, the outlet opening 220 may be relatively narrower than the cavity 214, and thus the velocity of the dry steam may increase prior to reentering the main steam path 202. The dry steam exiting the trailing edge 208 may reduce the size of secondary droplets 116, accumulated near the trailing edge 208. The dry exiting steam may energize the moisture film accumulated on the surface of the airfoil 200, reducing the size of the droplets, thus reducing the effect of the secondary droplets 116 on the steam turbine blades. As moisture may be substantially removed in upstream stationary airfoils 102 and droplet size of the remaining moisture may be reduced, the downstream rotating airfoils 104 may be less impacted by erosion.

In an alternate embodiment of the present invention, a steam/moisture separator (not illustrated) may be installed in the cavity 214. The separator may use centrifugal force, or impingement and gravitational forces, to separate the water from the steam-water mixture. For example, but not limiting of, a cylindrical pipe may be introduced in the cavity 214. Here, the steam-water mixture may be directed into the cylindrical pipe in the tangential direction allowing the water to separate due to the centrifugal force. The separated water may be collected and drained using the moisture draining facility 216. The moisture draining facility 216 may then discharge the separated water to a common receiver, such as, but not limiting of, a feed water reservoir or a condenser. Alternatively, the moisture draining facility 216 may simply discard the separated water. Alternatively, any conventional mechanism may be employed to separate water from steam within the cavity 214.

Figure 4:
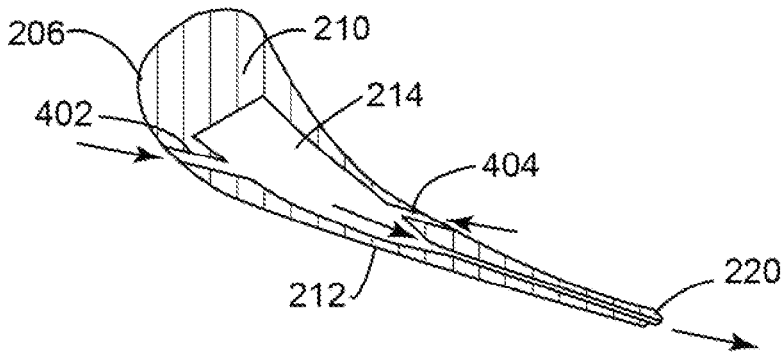
FIG. 4 is a schematic top view of an airfoil having multiple inlet openings, in accordance with an alternate embodiment of the present invention.

FIG. 4 is a schematic top view of an airfoil 200 having multiple inlet openings, in accordance with an alternate embodiment of the present invention. This embodiment may include a first inlet opening 402, which may be located near the leading edge 206 on the suction-side face 212; and a second inlet opening 404, which may be located along the pressure-side face 210. The outlet opening 220 may be located near the trailing edge 208, as illustrated in FIG. 2. During operation, secondary droplets 116 may impact the suction side leading edge 206. The inlet openings 402 and 404 of this alternate embodiment may be provided in this general area. This alternate embodiment seeks to maintain a minimum pressure difference between the inlet openings 402 and 404. The position of the inlet opening 404, along the pressure-side face 210, may be selected to keep the pressure difference between the two inlets at a minimum level for effective operation.

The structure of the cavity 214, including the inlet openings 402 and 404, and the outlet openings 220, may be similar to the structure described in connection with FIG. 2. The steam-water mixture from both the inlet openings 402 and 404 may enter the cavity 214. Here, the water may be separated from dry steam and exit via the outlet opening 220, as described.

FIG. 5 is a schematic isometric view of an airfoil 200 having multiple openings, in accordance with another alternate embodiment of the present invention.

The outlet opening 220 in this embodiment may be multiple ports that blow dry steam from the cavity 214 into the main steam path 202. In a similar embodiment, the inlet opening 218 can take the form of multiple ports. Moisture from the leading edge 206 surfaces may be directed into these ports due to the pressure drop. Recessed cavities may be provided around these inlet ports to facilitate moisture collection and to direct the moisture into the inlet ports. It will be understood that the inlet ports and outlet ports may be formed of any shape or number depending on the application and that any variation in inlet or outlet port shape, number, or size does not depart from the scope of the present invention.

FIG. 5 illustrates the moisture draining facility 216 discharging to a common receiver 500, in accordance with an alternate embodiment of the present invention. This embodiment may be applied on a steam turbine employing multiple airfoils 200 each of which having a moisture draining facility 216.

FIG. 5 illustrates a cavity 214 integrated with a swirling mechanism 510, in accordance with an alternate embodiment of the present invention. The swirling mechanism 510 may assist with separating the water from the steam of the steam/water mixture flowing through the airfoil 200. The swirling mechanism 510 may comprise the form of a swirler, impeller, or the like. Here, the steam/water mixture flowing through the airfoil 200 moves the swirling mechanism 510.

Whenever possible, common industry terminology has been used and employed in a manner consistent with its accepted meaning in this disclosure. It is intended, however, that any such terminology be given a broad meaning and not narrowly construed such that the meaning intended herein and the scope of the appended claims is unreasonably restricted. Those of ordinary skill in the art will appreciate that often certain components may be referred to with several different names. In addition, what may be described herein as a single part may include and be referenced in another context as consisting of several component parts, or, what may be described herein as including multiple component parts may be fashioned into and, in some cases, referred to as a single part. As such, in understanding the scope of the present invention, attention should not only be paid to the terminology and description provided, but also to the structure, configuration, function, and/or usage of the component as described herein.

As one of ordinary skill in the art will appreciate, the many varying features and configurations described above in relation to the several exemplary embodiments may be further selectively applied to form the other possible embodiments of the present invention. For the sake of brevity and taking into account the abilities of one of ordinary skill in the art, all of the possible iterations is not provided or discussed in detail, though all combinations and possible embodiments embraced by the several claims below or otherwise are intended to be part of the instant application. In addition, from the above description of several exemplary embodiments of the invention, those skilled in the art will perceive improvements, changes, and modifications. Such improvements, changes, and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

What is claimed is:

1. A system for removing moisture from a steam/water mixture engaging a stationary component of a steam turbine, the system comprising:

an airfoil disposed in a group of airfoils located within a flow path of a steam turbine, wherein the airfoil is configured for removing moisture from a steam/water mixture traveling in the flow path, the airfoil comprising:

first and second longitudinal ends and an outer peripheral wall that integrates the first and second longitudinal ends, wherein the first and second longitudinal ends and the outer peripheral wall collectively define: a leading edge, a trailing edge, a suction-side face, and a pressure-side face;

an extraction cavity laterally extending between a portion of the leading edge and a portion of the trailing edge, wherein the extraction cavity comprises an inlet opening in flow communication with the flow path, and an outlet opening in flow communication with the flow path; and a cavity configured for substantially separating the steam/water mixture into steam and water, wherein the cavity longitudinally extends within a portion of the airfoil; the cavity comprising a top end integrated with the extraction cavity, and a bottom end configured for allowing water to exit the airfoil;

wherein operatively as the steam/water mixture travels in the flow path, the inlet opening draws in a portion of the steam/water mixture, then a pressure drop across the leading edge and the trailing edge allows for the portion of the steam/water mixture to enter the cavity, and densities of the steam and water allow for the water to separate from the steam, wherein the water then flows towards the bottom end, and the steam flows through the outlet opening and returns to the steam path.

2. The system of claim 1, wherein the inlet opening is located on a portion of the leading edge.

3. The system of claim 2, wherein the outlet opening is located on a portion of the trailing edge.

4. The system of claim 1, further comprising multiple inlet openings.

5. The system of claim 1, further comprising multiple outlet openings.

6. The system of claim 1, further comprising a moisture drain integrated with the bottom end of the cavity.

7. The system of claim 6, further comprising a moisture draining system configured for removing the water from the airfoil.

8. The system of claim 1, wherein the inlet opening is located on the pressure side of the airfoil.

9. The system of claim 8, wherein the outlet opening is located on the trailing edge of the airfoil.

10. The system of claim 1 further comprising a swirling mechanism adapted for separating the water from the steam.

11. A system for removing water from a steam/water mixture engaging a stationary component of a steam turbine, the system comprising:

an airfoil disposed in a group of airfoils located within a flow path of a steam turbine, wherein the airfoil is configured for removing moisture from a steam/water mixture traveling in the flow path, the airfoil comprising:

first and second longitudinal ends and an outer peripheral wall that integrates the first and second longitudinal ends, wherein the first and second longitudinal ends and the outer peripheral wall collectively define: a leading edge, a trailing edge, a suction-side face, and a pressure-side face;

an extraction cavity laterally extending between a portion of the leading edge and a portion of the trailing edge, wherein the extraction cavity comprises an inlet opening in flow communication with the flow path, and an outlet opening in flow communication with the flow path; wherein the inlet opening is located on a portion of the leading edge; and wherein the outlet opening is located on a portion of the trailing edge; and a cavity configured for substantially separating the steam/water mixture into steam and water, wherein the cavity longitudinally extends within a portion of the airfoil; the cavity comprising a top end integrated with the steam extraction cavity, and a bottom end configured for allowing water to exit the airfoil;

wherein operatively as the steam/water mixture travels in the flow path, the inlet opening draws in a portion of the steam/water mixture, then a pressure drop across the leading edge and the trailing edge allows for the portion of the steam/water mixture to enter the cavity, and densities of the steam and water allow for the water to separate from the steam, wherein the water then flows towards the bottom end, and the steam flows through the outlet opening and returns to the steam path.

12. The system of claim 11, further comprising at least two inlet openings, wherein the at least two inlet openings comprise a plurality of discrete holes communicating with the flow path.

13. The system of claim 11, further comprising at least two outlet openings, wherein the at least two outlet openings comprise a plurality of discrete holes communicating with the flow path.

14. The system of claim 11, further comprising a water drainage system integrated with the bottom end of the cavity, wherein the water drainage system is configured for removing the water from the airfoil.

15. The system of claim 14, further comprising multiple airfoil groups, wherein each group comprises a stage.

16. The system of claim 15, wherein the cavity associated with each stage comprises a size relative to an estimated amount of water content within the steam/water mixture at each stage.

17. The system of claim 16, wherein the water drainage system of each stage is integrated and operatively discharges the fluid to a common receiver.

18. The system of claim 11, wherein the inlet opening is adjacent the pressure side of the airfoil.

19. The system of claim 18, wherein the outlet opening is adjacent the trailing edge of the airfoil.

20. The system of claim 11, a swirler adapted for separating the water from the steam, wherein a portion of the swirler is located within the cavity.

* * * * *